US005716283A

United States Patent [19]

Simpson et al.

[11] Patent Number: 5,716,283

[45] Date of Patent: Feb. 10, 1998

[54] PRACTICE BALL SYSTEM FOR TRAINING IN THE PLAYING OF POOL AND POCKET BILLIARDS

[75] Inventors: Thomas E. Simpson, Dublin; Joseph H. Oshins, Columbus, both of Ohio

[73] Assignee: Elephant Balls, Inc., Dublin, Ohio

[21] Appl. No.: 507,702

[22] Filed: Jul. 26, 1995

[51] Int. Cl.[6] ..... A63B 37/00

[52] U.S. Cl. ..... 473/2

[58] Field of Search ..... 473/2, 52, 253, 473/254, 251, 252, 40; 273/60, 26 R, 29 A, 56, 61 A, 58 C, 58 R, 58 A, 61 R, 411, 65 R, 72 R, 73 R, 88, 108, 125

[56] References Cited

U.S. PATENT DOCUMENTS

| | | | |
|---|---|---|---|
| 513,876 | 1/1894 | Burt | 473/52 |
| 666,333 | 1/1901 | Stevens | 473/52 |
| 984,463 | 2/1911 | Beltran | 473/52 |
| 1,108,441 | 8/1914 | Hubbell | 473/52 |
| 1,118,727 | 11/1914 | Bibeault | 473/52 |
| 3,231,278 | 1/1966 | Boulanger | 273/411 |
| 3,466,038 | 9/1969 | Hill | 473/40 |
| 3,504,914 | 4/1970 | Bradbury | 473/125 |
| 3,993,305 | 11/1976 | Nicholson | 473/2 |
| 4,116,439 | 9/1978 | Chavarria | 473/52 |
| 4,345,759 | 8/1982 | Nims | 273/65 R |
| 4,526,368 | 7/1985 | Furda | 473/52 |
| 4,546,975 | 10/1985 | Nims | 273/65 R |

FOREIGN PATENT DOCUMENTS

| | | | |
|---|---|---|---|
| 317138 | 8/1929 | United Kingdom | 273/58 A |

*Primary Examiner*—Theatrice Brown
*Attorney, Agent, or Firm*—Mueller and Smith, LPA

[57] ABSTRACT

A practice ball system for training in the playing of pool or pocket billiards. The system includes a cueball having a generally spherical outer surface extending about an axis of revolution circumscribed by a central meridian, and which is movable along a playing surface from impact by a cue having a tip of a given outer diameter. The cueball has first indicia on the outer surface defining the central meridian which is visually perceptible as the ball is moving along the playing surface for discerning the rotation of the ball. The system also includes an object ball having a generally spherical outer surface extending about an axis of revolution circumscribed by a central meridian, and which is movable along a playing surface from impact by the cueball. The object ball has a first hemisphere having an outer surface of a first color, and a second hemisphere having an outer surface of a second color generally contrasting with the first color. The first and second hemisphere meet along a circular locus defining the central meridian of the object ball, which meridian is visually perceptible as the ball is moving along the playing surface for discerning the rotation of the ball.

21 Claims, 2 Drawing Sheets

PRACTICE BALL SYSTEM FOR TRAINING IN THE PLAYING OF POOL AND POCKET BILLIARDS

BACKGROUND OF THE INVENTION

The present invention relates broadly to a training system for the playing of pool and pocket billiards which utilizes practice cueball and object balls having indicia providing visual data relating to aiming and the effect of the stroke on the motion of the balls.

On one level, the game of pool, which is also known as pocket billiards, may be enjoyed as a relaxing pastime played amongst friends or family. On another level, pool may played as a competitive sport requiring a mastery of aiming, positioning, speed, spin, cut, combinations, carom, bank, deflection, draw, follow, squirt, stun, natural roll, center-ball english, throw, and other cuestick and ball phenomena.

Indeed, one of the most fascinating and often misunderstood aspects of pool is the relationship of physics to the geometry of the game. Most players tend to think of the interaction of the balls and rails as governed by a set of fixed geometric principles, and this would be true if the motion of the balls had no spin, momentum, or acceleration components. Balls do bounce, spin, and roll, however, making pool more of a game of physics than geometry.

A ball may be considered to be rolling naturally when traveling the length of its circumference per revolution. In may instances, however, the ball cannot be characterized as rolling naturally. With a draw shot, for example, the cueball actually is spinning backwards and skidding across the table into impact with the object ball. With other shots, the cueball may be both rolling with top spin and skidding such that it travels the equivalent of two or three circumferences in one revolution. It is known that some skidding will occur with all center ball or low hits, and, with an elevated cue, even on high ball hits. A center ball hit at medium speed will have some skid before assuming a natural roll.

If rolling when striking an object ball, the cueball thereafter will tend to continue to roll. On a flush hit, a rolling ball will follow the object ball. On an angled hit, the cueball will carom off at an angle, but also will continue to roll forwards. Likewise, if the cueball is skidding but spinning backwards when striking an object ball, the cueball will back up on a flush hit, or deflect at a greater angle on a cut shot. If skidding without either topspin or backspin when striking an object ball, however, the cueball will deflect at a 90° angle off an object ball. As is apparent, the physical combination of angular deflection and rolling momentum makes the exact path of the cueball difficult to predict accurately even for experienced players.

Although the physics of the game undeniably complicates predicting and understanding the effects of any particular shot, such complexity contributes to making pool such a rich and enduring sport, and a never-ending challenge for most players. For those wishing further insight on the fundamentals and science of the game, reference may be had to the following publications, the disclosures of which are expressly incorporated herein by reference:

Koehler, Jack H., "The Science of Pocket Billiards," Sportology Publications, Laguna Hills, Calif. (1989).

Byrne, R., "Byrne's Standard Book of Pool and Billiards," Harcourt, Brace, Jovanovich, San Diego, Calif. (1987).

At whatever level the game is played, it is necessary for the player to understand how the cueball behaves when stroked, and how the object balls behave when impacted by the cueball. In this regard, and especially given the complex interaction between the geometry and physics of the game, visual feedback from the balls is particularly important in conditioning the mind and body of the player to develop a sense of what will happen on any particular shot. The relatively high speed and spin of the cueball and object balls, however, make it difficult for most players to perceive anything but the crude results of each shot. This difficulty is intensified with respect to the cueball as its solid white color makes it almost impossible for the player to see the spin, slide, or roll of the ball, or to locate the center of the ball for aiming. Moreover, the chalkmark which is transferred to the cueball from the tip of the cue may provide the player with valuable information as to whether the actual stroke contacted the cueball where intended. The absence of any reference points on the surface of a standard cueball, however, effectively precludes the player from gleaning any meaningful information from the chalkmark.

In view of the foregoing, it will be appreciated that practice systems and other aids for training in the playing of pool would be well-received by players of all skill levels. A preferred system would be economic and easy to use, and would provide the player with immediate visual feedback as to the effect of each shot.

BROAD STATEMENT OF THE INVENTION

The present invention is addressed to a training system for the playing of pool and pocket billiards which utilizes a practice cueball and object ball having indicia supplying visual data to the player relating to aiming and to the effect of the stroke on the motion of the balls. In combining improved sighting and alignment capabilities with immediate visual feedback, the system allows the player to select a proper aiming point and to discern immediately how close the actual stroke came to the selected aiming point. After the stroke, the indicia provided assists the player in understanding the effect of the stroke on the ultimate motion of the balls. By following a training regime with exercises designed to exploit the capabilities of the practice ball system of the present invention, a player may improve his or her aiming techniques and also learn how to stroke the cueball to achieve such effects as spin, stun, follow, and draw.

It is therefore a feature of the present invention to provide a practice cueball for training in the playing of pool or pocket billiards. The cueball has a generally spherical outer surface extending about an axis of revolution circumscribed by a central meridian, and is movable along a playing surface from impact by a cue having a tip of a given outer diameter coatable with chalk. First indicia on the outer surface of the cueball define the central meridian which is visually perceptible as the ball is moving along the playing surface for assisting the player in discerning the rotation of the ball.

It is also a feature of the present invention to provide an object ball for training in the playing of pool or pocket billiards. The object ball has a generally spherical outer surface extending about an axis of revolution circumscribed by a central meridian, and is movable along a playing surface from impact by a cueball. A first hemisphere of the ball has an outer surface of a first color, and a second hemisphere has an outer surface of a second color generally contrasting with the first color. The first and second hemisphere meet along a circular locus defining the central meridian which is visually perceptible as the ball is moving along the playing surface for discerning the rotation of the ball.

It is a further feature of the invention to provide a method for training in the playing of pool or pocket billiards which involves the provision of a practice cueball. The cueball has a generally spherical outer surface extending about an axis of revolution circumscribed by a central meridian, and is movable along a playing surface from impact by a cue having a tip of a given outer diameter. First indicia on the outer surface of the cue define the central meridian which is visually perceptible as the ball is moving along the playing surface for discerning the rotation of the ball. With the first indicia of the cueball being aligned relative to the playing surface, the cueball is impacted with the tip of the cue to move the cueball along the playing surface. The rotation of the cueball then is discerned by visually perceiving the motion of the first indicia.

It is yet a further feature of the invention to provide a method for training in the playing of pool or pocket billiards which involves the provision of a practice cueball and object ball. The cueball has a generally spherical outer surface extending about an axis of revolution circumscribed by a central meridian, and is movable along a playing surface from impact by a cue having a tip of a given outer diameter. First indicia on the outer surface of the cue define the central meridian which is visually perceptible as the ball is moving along the playing surface for discerning the rotation of the ball. The object ball has a generally spherical outer surface extending about an axis of revolution circumscribed by a central meridian, and is movable along a playing surface from impact by the cueball. A first hemisphere of the object ball has an outer surface of a first color, and a second hemisphere has an outer surface of a second color generally contrasting with the first color. The first and second hemisphere meet along a circular locus to the central meridian of the object ball which meridian is visually perceptible as the ball is moving along the playing surface for discerning the rotation of the ball. The defined central meridian of the object ball is aligned with an aiming point of the playing surface, with the first indicia of the cueball being aligned relative thereto. The cueball is impacted with the tip of the cue to move the cueball into impact with the object ball. The rotation of the cueball and the object ball are discerned by visually perceiving, respectively, the motion of the first indicia and the defined central meridian.

The invention, accordingly, comprises the apparatus and method possessing the combination of elements and arrangement of steps which are exemplified in the following detailed description. Reference to that description and to the accompanying drawings should be had for a fuller understanding and appreciation of the nature and objects of the invention, although other objects may be obvious to those skilled in the art.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
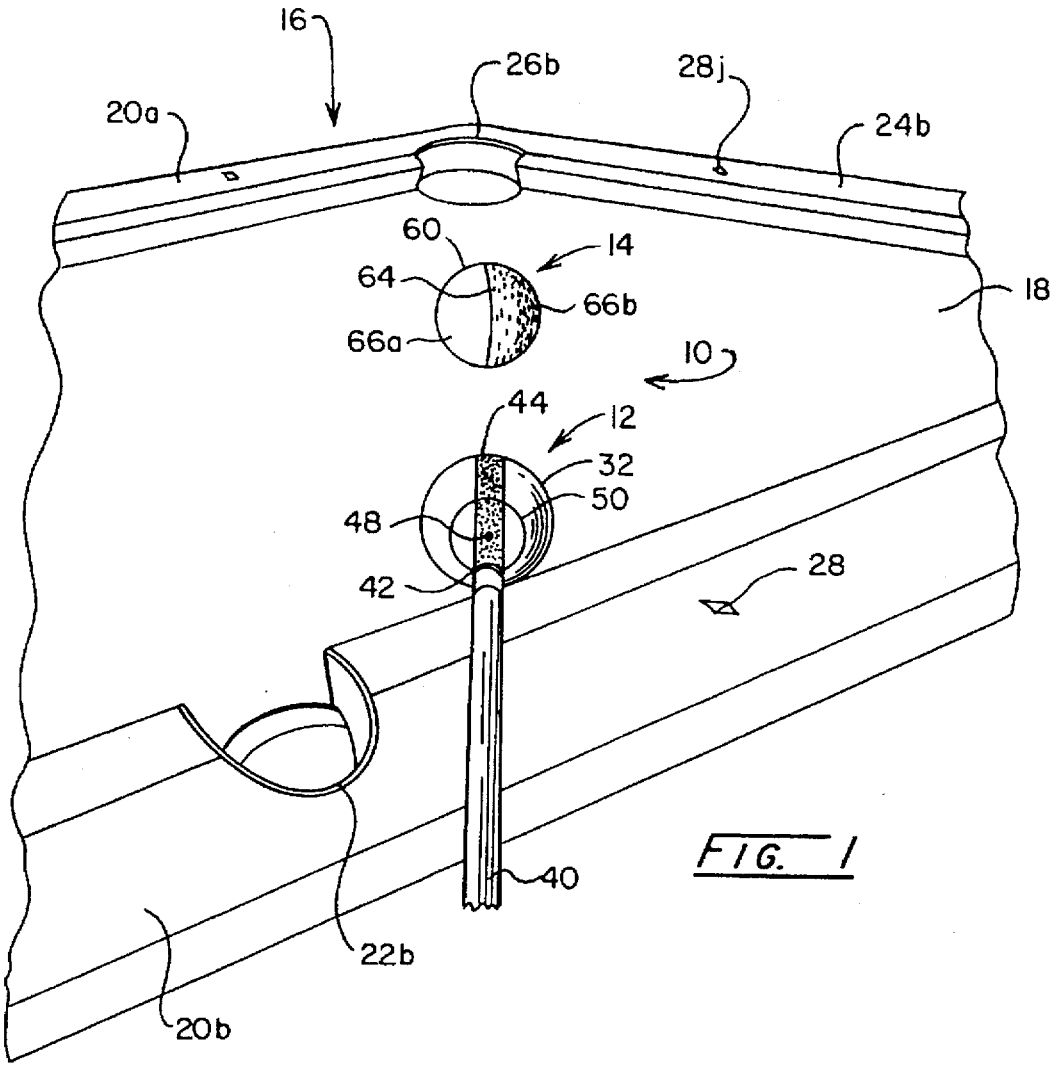
FIG. 1 is a perspective view showing the practice cueball and practice object ball of the present invention as aligned for a shot on the playing surface of a pool table.

Referring to FIG. 1, the practice ball system of the present invention is shown generally at 10 as including a practice cueball, shown at 12, aligned for a shot with a practice object ball, shown at 14. For illustrative purposes, practice balls 12 and 14 of system 10 are shown as disposed on a standard pool table, at portion of which is shown generally at 16, having a planar playing surface, 18, supporting balls 12 and 14. Looking additionally to FIG. 4, wherein a top view of table 16 is shown in schematic, playing surface 18 may be seen to be bounded by a pair of side rails, 20*a* and 20*b*, which include side pockets 22*a* and 22*b*, and a pair of end rails, 24*a* and 24*b*, which connect corner pockets 26*a–d*. For purposes of reference, rails 20 and 24 are shown as including diamonds or sights, one of which is enumerated at 28, and playing surface 18 is shown as marked with a footspot, 30.

Figure 2:
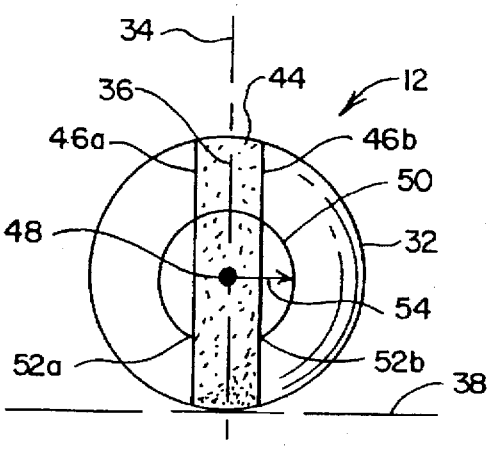
FIG. 2 is a front view showing the practice cueball of FIG. 1 in enhanced detail.

Referring next to FIG. 2, practice cueball 12 of the present invention is illustrated in enhanced detail, and is revealed to have a generally spherical outer surface, 32, extending about an axis of revolution, represented at 34, and circumscribed by a central meridian, represented in phantom at 36. Looking additionally to FIG. 1, cueball 12 may be seen to be movable along playing surface 18 of table 16, which movement may include rolling about an instantaneous axis of rotation, represented at 38 in FIG. 2, from impact by a cue, 40, having a tip, 42, of a given outer diameter. The outer surface 32 of cueball 12 includes first indicia, shown at 44, which defines central meridian 36. In accordance with the present invention, first indicia 44 is provided to be visually perceptible as cueball 12 is moving along playing surface 18. Thus, the player is supplied visual data for discerning the rotation of cueball 12.

In a preferred embodiment, first indicia 44 comprises a first and second boundary, 46*a* and 46*b*, which defines a section of cueball 12 including central meridian 36. Indicia 44 therefore is shown as a colored band circumscribed about the outer surface 32 of cueball 12. To enhance its contrast with the standard white color of the cueball 12 and to highlight chalkmarks thereon, first indicia 44 preferably is provided as a black band which may be painted, printed, inlaid, or otherwise incorporated into surface 32. As a feature of the invention, the band of indicia 44 may be selected as having a width of about 13 mm (0.51 in) which corresponds to the standard size of the outer diameter of tip 42 of cue 40. For use with cues, such as those for snooker, having smaller tips, the width of the band of indicia 44 may be sized proportionately.

For use in training, and as is illustrated best in FIG. 1, first indicia 44 may be aligned in a generally vertical orientation with respect to playing surface 18 and in registry with an aiming point of the surface such as pocket **26*b* or with object ball 14. In this way, indicia 44 assists the player in properly aligning the shot, with the selected width of the band improving the focus of the player in shooting "through" the ball. Alternatively, indicia 44 may be aligned in a generally horizontal orientation with respect to playing surface 18. In whatever orientation indicia 44 is disposed, however, the motion thereof after the stroke, as influenced by the rolling, skidding, sliding, and spinning of cueball 12**, provides the player with valuable visual feedback, such as from a "moiré" or similar pattern, as to the precise effect of the stroke on the resulting travel of the ball. The player may obtain this feedback by visually perceiving the motion of the indicia to discern the rotation of the cueball. In some instances, as with stun shots, the player in fact may observe no rotation, i.e., the non-rotation, of the ball indicating that the ball is skidding or sliding rather than rolling. Such an observation itself is an important indication as to the motion of the ball.

Returning to FIG. 2, cueball 12 may be seen to additionally include second indicia, shown at 48, defining a central aiming or reference point on meridian 36. Preferably, second indicia 48 is provided as a red spot which, as before, is painted, printed, inlaid, or otherwise incorporated into outer surface 32 of cueball 12. As is shown in FIG. 1, second indicia 48 may be utilized by the player for more precise aiming and for measurement of center ball hits with tip 42 of cue 40 wherein cueball 12 is made to rotate about axis of rotation 38 (FIG. 2). After the stroke, the motion of first indicia 44 provides immediate visual feedback to the player as to whether he or she was successful in achieving an intended centerball hit of cueball 12. It therefore will be appreciated that first and second indicia 44 and 48 function synergistically in facilitating shot alignment and in providing visual information as to the effect of the stroke on the ultimate motion of the ball.

Looking again to FIG. 2, cueball 12 may be seen to further include third indicia, shown at 50, which at least partially circumscribes the central reference point defined by second indicia 48. Third indicia 50 preferably is provided as defining a semi-circular locus which intersects first indicia 44 in extending from a first end, **52*a*, at first boundary 46*a*, to a second end, 52*b*, at second boundary 46*b*. As before, third indicia 50 may be of a contrasting color such as red, and may be painted, printed, inlaid, or otherwise incorporated into outer surface 32 of cueball 12. So provided, third indicia 50 thus defines an impact region or miscue circle for contact by the tip of the cue effective to rotate cueball 12 about an axis of spin, which may be coaxial, for example, with axis of revolution 34, and which is disposed generally perpendicular or at some other angle to axis of rotation 38 or playing surface 18 (FIG. 1). Indicia 50 therefore delineates the limits within which cueball 12 may be stroked to generate useful english or spin. That is, strokes wherein tip 42 of cue 40 (FIG. 1) impacts cueball 12 outside the impact region defined by third indicia 50 will tend to result in either a miscue or an errant shot. For a standard cueball having a diameter of 2.25 inches (5.7 cm), the critical radius, represented at 54 in FIG. 2, of the impact region defined by third indicia 50 has been found to be about 0.5625 inch (14.28 mm) as measured from the center of the central reference point defined by second indicia 48. Again, for smaller cueballs for use in games such as snooker, the diametric extent of indicia 50** may be sized proportionately.

The provision of the aforementioned indicia on the outer surface 32 of cueball 12 additionally assists the player in ascertaining meaningful information from the chalkmark which is typically transferred to the ball at the point of impact with the tip of the cue. As may be better appreciated with particular reference to FIG. 1, it is common for players to coat the tip of the cue with a layer of a chalk such as calcium carbonate to increase the friction with the surface of the ball. Increasing the friction between the tip of the cue and the surface of the ball is known to reduce the instances of miscue wherein the cue tip slips off the surface of the ball during impact. Normally, a portion of the chalk layer is transferred from the cue tip to the surface of the cueball as a chalkmark. This mark evidences the exact location where the tip of the cue contacted the surface of the cueball. With respect to a standard white cueball, the absence of any reference points on the surface thereof effectively precludes the player from gleaning any meaningful information from the location of chalkmark. With respect to the cueball of the present invention, however, it will be appreciated that the indicia incorporated into the surface thereof provide landmarks from which the location of the chalkmark relative to the aiming point may be obtained, providing the player with valuable information as to whether the actual stroke contacted the cueball where intended and, ultimately, why the balls behaved as they did on the shot in question.

To enhance the visibility of the chalkmark, it is preferred that cueball 12 of the present invention be molded or otherwise formed of a material have a surface texture and other surface characteristics selected to receive the chalkmark from the tip of the cue. In this regard, it has been found that certain thermoset resins, one of which is marketed under the tradename PARTEC™ by the E. Parrella Co. of Medway, Mass., retains chalkmarks appropriately. Such material is to be contrasted with the phenolic resin typically used for billiard balls which produces a ball having a surface which is harder and of a higher gloss than the surface of the ball of the present invention. In all other aspects such as diameter, weight, sphericity, balance, and behavior, however, the performance of the inventive cueball is comparable to that of a standard cueball.

Advantageously, the provision of third indicia 50 as defining a semi-circular locus assists the player in determining the location of the chalkmark relative to the initial orientation of the ball. For example, before the shot, and as is shown in FIG. 1, cueball 12 may be aligned such that the discontinuous portion of third indicia 50 is oriented towards the bottom portion of the ball. After the shot, the player then may use the indicia as a reference from which may be determined the location of the chalkmark relative to the original orientation of the ball.

Figure 3:
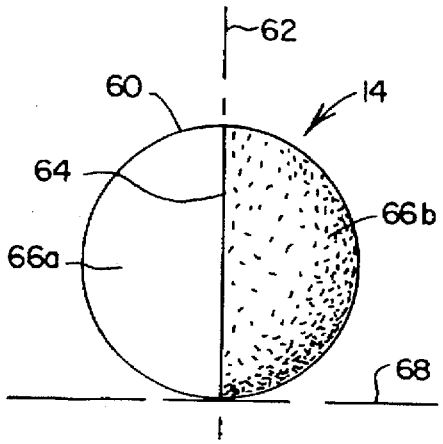
FIG. 3 is a front view showing the practice object ball of FIG. 1 in enhanced detail.

Referring next to FIG. 3, object ball 12 of the present invention is illustrated in enhanced detail to have a generally spherical outer surface, 60, extending about an axis of revolution, represented at 62. Outer surface 60 is circumscribed by a central meridian, represented at 64, which divides ball 14 into a first and second hemisphere, **66*a* and 66*b*, respectively. From impact with a cueball such as cueball 12 of the present invention (FIG. 2), object ball 14 is movable along playing surface 18 (FIG. 1), which movement may include rotation about an axis of rotation, represented at 68. In accordance with the present invention, first hemisphere 66*a* is provided as being of a first color, such as red, with second hemisphere 66*b* being provided as being of a second, contrasting color, such as black. So colored, first and second hemispheres 66 meet along a generally circular locus defining central meridian 64. As object ball 14 is moving along the playing surface, the defined central meridian 64** thereof is visually perceptible by the player for discerning the rotation including the non-rotation, i.e., the skidding or sliding, of the ball. If the ball is spinning, a "moiré" or like effect will be developed from which the player may recognize the rotation of the ball.

Returning again to FIG. 1, the training system of the present invention is illustrated in connection with the utilization of object ball 14 with cueball 12. In this regard, the defined central meridian 64 of object ball 14 is aligned generally vertically with respect to playing surface 18, and with an aiming point of playing surface 18 such as pocket **26*b*. First indicia 44 of cueball 12 then may be aligned generally vertically to playing surface 18, and relative to the aiming point and the defined central meridian 64 of object ball 14. With cueball 12 and object ball 14 aligned in registration, cue 40 may be stroked to contact with tip 42 thereof the surface 32 of cueball 12 within the miscue circle defined by third indicia 50 such as at the central reference point defined by second indicia 48. Cueball 12 is thereby made to move along playing surface 18 into impact with aligned object ball 14. Object ball 14, in turn, is made to move along playing surface 18 towards pocket 26*b*. The rotation, including the non-rotation, of both cueball 12 and object ball 14 may be discerned by the player for gaining information about the travel of the of the balls by visually perceiving, respectively, first indicia 44 of cueball 12 and the defined central meridian 64 of object ball 14. After the shot, the chalkmark transferred to cueball 12 may be located by the player relative to the original orientation of the ball by using third indicia 50 as a reference. Thus, by virtue of practice ball system 10** of the present invention, the player is provided immediate and valuable visual information as to aiming and as to the effect of that aim on the ultimate motion of the balls.

The examples to follow are illustrative of exercises which may be included in training regime designed to exploit the capabilities of the practice ball system of the present invention. By following the such a regime, a player may improve his or her aiming techniques, and also learn how to stroke the cueball to achieve such effects as spin, stun, follow, and draw. These examples, however, are only illustrative of the precepts of the present invention, and therefore should not be construed in any limiting sense.

EXAMPLES

Each of the following exercises are designed to teach the player a particular technique or shot. For the maximum training effect with any of the exercises, however, the cueball should be cleaned with a dry cloth prior to each shot. Cleaning the cueball assists the player in identifying chalkmarks, forces the player to concentrate on each individual shot, and also ensures a consistent behavior of the balls.

Figure 4:
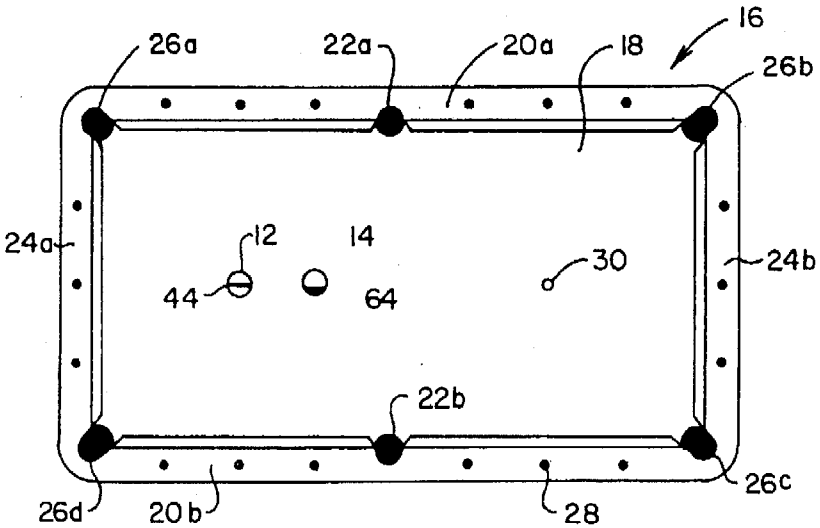
FIG. 4 is a schematic of a top view of the pool table of FIG. 1 showing the practice cueball and object ball of the present invention as aligned with the footspot for center ball aiming and stroking exercises.

The balls also should be carefully aimed and aligned such that the player may more easily differentiate between stroke effects and aiming inconsistencies. With reference to FIG. 4, wherein a top view of table 16 of FIG. 1 is represented in a somewhat schematic fashion, for aiming an aligning cueball 12, the band defined by first indicia 44 is aligned generally vertically with respect to playing surface 18 and in registry with an aiming point such as footspot 30. The player is encouraged to view the alignment at different angles to account for any parallax errors. Once the aiming alignment has been confirmed, the ball may be viewed from the side to ensure that second and third indicia 48 and 50 (FIG. 2) are centered.

For assisting the player in aligning the cueball in an exact vertical or horizontal orientation with respect to first indicia 44, an alignment tool may be provided as comprising a generally rectangular, planar member having an notched formed into an upper edge thereof. To align the cueball band generally horizontally, the tool is stood on its edge, and the ball is rotated until the spot of second indicia 48 appears in the notch. The edge of the band of indicia 44 then may be aligned in an exact horizontal orientation with the upper edge of the tool. To align the cueball band generally vertically, the tool is stood on an end thereof such that the notch is present to either side instead of the top of the tool.

Similarly, for aligning object ball 14, the ball is oriented with the defined central meridian 64 thereof generally vertically with respect to playing surface 18. The ball then may be sighted along the aligned meridian 64 with an aiming point.

Lastly, it is suggested that the player spend equal time mastering both the aiming and stroking techniques to follow. If the aim is straight and true, the system of the present invention will reveal any problems or variations in the stroke. Conversely, if the stroke is straight and true, the system will reveal any problems or variations in the aim. Stroking and aiming techniques therefore are alternated hereinafter to encourage the player to do the same while at the table.

In the following exercises, cue strokes are characterized as "soft," "medium," "hard," or "power." In this regard, the common industry standards regarding stroke power or speed relative to ball travel have been adopted as is shown in the table which follows:

TABLE

Stroke Power versus Ball Travel Distance

| Stroke Power | Ball Travel Distance |
|---|---|
| Soft | 1 table length |
| Medium | 2 table lengths |
| Hard | 3–4 table lengths |
| Power | 5 table lengths |

Exercise 1

Center Ball Aiming and Stroking

The easiest and best way to aim a cueball is to stroke through its exact center with a level cue directly toward the exact point of aim. With general reference to FIG. 4, the exercise is begun by placing cueball 12 at the headspot (hidden from view) with indicia 44 generally vertical to playing surface 18 and in alignment with footspot 30. The ball is rotated such that second indicia 48 (not shown) is in the center of the ball along the line of aim. The player assumes a stance, and the ball is stroked at second indicia 48 through first indicia 44 with, successively, soft, medium, and hard strokes. If first indicia 44 is seen to wobble, an off-center hit is indicated. It is important that the player view the ball both before and after it hits foot rail **24*b* as any wobble is accentuated as the ball caroms off the rail. The other visual indication of an on-center hit is the chalkmark which is transferred to cueball 12. If the aim was true, footspot 30** will be crossed both before and after the impact of the ball with the rail.

Exercise 2

Object Ball Alignment and Center Ball Hits

With continuing reference to FIG. 4, cueball 12 is placed on the headspot as was described in connection with Exercise 1. Object ball 14 is placed in the center of table 16, one diamond 28 from cueball 12, with its defined central meridian 64 aligned with footspot 30. The player assumes a stance, and cueball 12 is stroked through second indicia 48 and first indicia 44 to central meridian 64 of object ball 14. Again, as cueball 12 is moving, the player watches for any wobbling of first indicia 44. If properly stroked, cueball 12 will stop dead at impact with object 14 with first indicia 44 still in alignment with footspot 30. After impact, object ball 14 is viewed for any wobble of central meridian 64 both before and after the ball hits foot rail **24*b*. Executed properly, object ball 14 will rebound off the rail, cross footspot 30, and hit cueball 12 in the center of table 16** sending the cueball back towards the headspot.

Exercise 3

Aiming and Pocketing Balls

Figure 5:
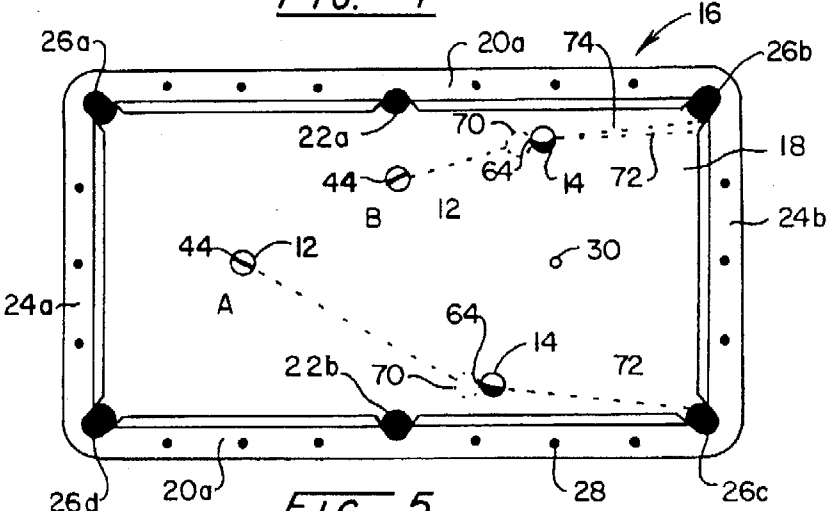
FIG. 5 is a schematic of a top view of the pool table of FIG. 1 showing the practice cueball and object ball of the present invention in alignments for aiming and pocketing ball exercises.

Referring next to FIG. 5 and looking initially to ball alignment "A" thereof, object ball 14 is set such that defined central meridian 64 thereof is aligned directly, with corner pocket **26*c*. To properly execute the shot, cueball 12 must be aimed such that it impacts object ball 14 at the nearest point of central meridian 64. To visualize this point, it is helpful for the player to imagine a "ghost ball," represented in phantom at 70, adjacent object ball 14. Cueball 12 is stroked such that it replaces the ghost ball. In theory, object ball 14 will travel into pocket 26*c*, along the line represented at 72 which radiates from central meridian 64, regardless of its distance or angle from cueball 12**.

Unfortunately, however, as the surfaces of the two balls collide and slide across one another, the resulting friction develops a drag called "throw" which pushes the object ball off of line 72. As is illustrated in ball alignment "B," this throw component of force will be vectored in the direction of cueball motion and will push object ball 14 at some angle thereto along, for example, the line represented at 74. Indeed, throw may alter the cut angle of a shot by as much as 5°, an effect which is magnified by distance on longer shots. To compensate for throw, object ball 14 may be aligned as in alignment "A" with the center of the pocket to move the cueball target and achieve a slightly thinner ghost ball hit. Alternatively, object ball 14 may be aligned as in alignment "B" to the outside of the pocket with a flush ghost ball hit.

Exercise 4

Throw Shots

Figure 6:
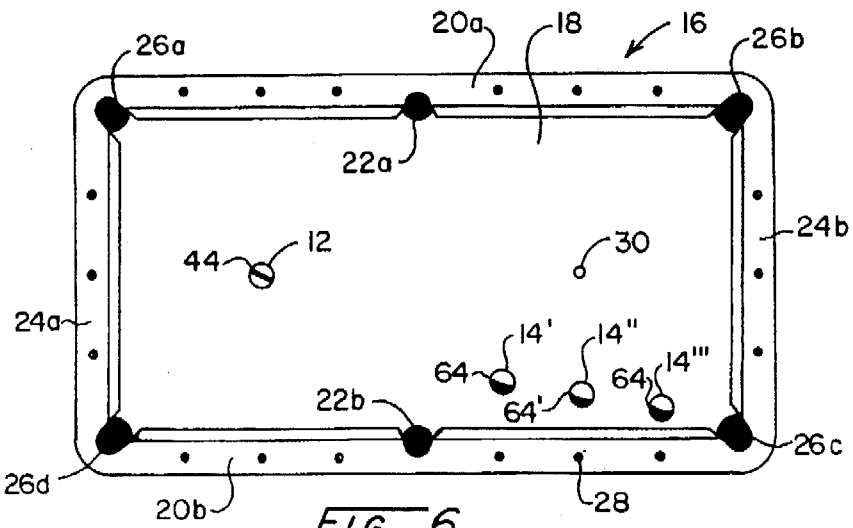
FIG. 6 is a schematic of a top view of the pool table of FIG. 1 showing the practice cueball and object ball of the present invention in various alignments for throw shot exercises.

Three separate practice shots, represented by object balls 14', 14" and 14'", may be arranged as is shown in FIG. 6. The defined central meridian 64 of each of object balls 14 is aligned with the center of pocket **26*c* from each of the three marked positions. First indicia 44 of cueball 12 is aligned with the center of a "ghost ball" visualized adjacent each of object balls 14. Each shot is executed without adjustment for throw, and the results are observed from the motion of the balls and the chalkmarks transferred to cueball 12. It will be observed that the effects of throw increase proportional to the cut angle and the distance of the object ball from the pocket, and that softer strokes generate more throw than harder strokes. The exercise may be repeated at each object ball position at successively greater distances from the cueball. Once each shot on the left side of table 16 has been properly executed, this exercise, as with all exercises, may be repeated from the right side of table 16** to ensure that the player develop a balanced table presence.

Exercise 5

Spin, Squirt, and Curve

The addition of a spin or "english" component to the motion of the cueball complicates the shot and therefore is to be avoided unless absolutely necessary. One of the great ironies of pool is that the better the player, the less the player needs to rely on spin to execute a shot. However, while demanding greater skill, the use of spin affords good players many options for shot making and position play, the mastery of which is necessary to truly excel at the game.

The practice ball system of the present invention provides the player with valuable visual signals relating to the spin of the ball. In this regard, cueball 12 is set on the headspot, aimed with the footspot, and aligned such that first indicia 44 is vertical and second indicia 48 defines the center ball aiming point. The player then strokes the ball at the right edge of first indicia 44 with a soft, level cue to impart a right spin component to the motion of the ball. It will be observed that the cueball "squirts" to the left of its desired path, and then curves slightly back towards the target. The exercise may be repeated at varying cue speeds from both the right and left side of the ball, and with an elevated cue. The distance from first indicia 48 at which the cueball is stroked also may be varied so that the player study the effects of spin on aim and on position.

Unfortunately, the amount and squirt and curve of a spinning cueball is impossible to quantify. That is, the magnitude depends not only on the stroke speed and aiming point, but also on such variables as the flexibility of the cue and the curvature of the tip.

Exercise 6

Effect of Spin on Position

Although squirt and curve are generally to be considered as necessary evils, spin can be a great ally in position play. To demonstrate the effect of spin on position, cueball 12 is set up and executed as was described in connection with Exercise 5, with a marker placed at where the ball stops or hits the rail. The exercise may be repeated for at varying cue speeds, and from both the right and left side of the ball. If the same spot on the cueball is hit and the aim is proper, it will rebound off the rail at a consistent rebound angle for a given cue speed. In this way, the player may understand how just a little spin effects the rebound angle, especially with a soft cue stroke.

Exercise 7

Spin Angles Off the Rail

Using the same set up as was described in connection with Exercises 5 and 6, cueball 12 is stroked at progressively greater distances from the center ball aiming point defined by second indicia 48, the outer boundary being defined by miscue circle of third indicia 50. The exercise is repeated with soft, medium, and hard strokes. The player will realize that stroking the ball at progressively greater distances from its center has proportionately less effect on the rebound angle, but makes it increasingly difficult for the player to be accurate. Thus, a point of diminishing returns is reached defining the outer limits of useful english. With practice, the player will become able to predict the angle of the ball off the foot rail for any given stroke speed and amount of spin.

Exercise 8

Outside and Inside Spin Off the Rail

With a knowledge of how the speed of the shot affects the rebound angle off the foot rail, and how soft strokes increase and hard strokes decrease the angle, the player is ready to attempt some shots. In this regard, the cueball is placed as was described in connection with Exercises 5, 6, and 7, with the point of indicia 48 centered and the band of indicia 44 vertical. The ball is aimed at first diamond left of the right corner pocket, and stroked in the center with a soft cue. The chalkmark and wobble are checked to ensure that the center of the ball was hit, along with the angle of the ball off the back and side rails and its ending position. The shot is repeated with the same velocity, but with a point of aim on the cueball at the right edge of the band of indicia 44. Once again, the player checks the chalkmark and notes the angles of return and the position of the stopped ball.

The above exercise demonstrates the effects of, variously, "outside," "natural," or "running" english. Outside refers to the way the spin relates to the object ball, i.e., the contact point of the cue tip on the cueball is "outside" or away from the ball. Natural english refers to the natural effect of hitting a rail which is to impart spin to the cueball in the direction of the angle. Running refers to the phenomenon of the cueball gaining speed when it strikes the rail to "run" farther than its initial speed would suggest. The opposite effect is termed, variously, "inside," "reverse," or "hold-up" spin. To understand this effect, the player may execute the same shot, but with a point of aim to the left edge of the band defined by first indicia 44. Not surprisingly, the effects are opposite, viz., the rebound angles off the foot and side rails are smaller, and the ball stops shorter.

Exercise 9

How Object Balls Affect Cueball Spin

The final component necessary for the player to understand spin and to use it judiciously is to examine what happens when a spinning cueball strikes an object ball. Cueball 12 is placed about a foot (30.5 cm) from the left side pocket, with object ball 14 placed in the center of the table. The cueball is aligned with the spot of second indicia 48 in the center and with the band of first indicia 44 vertical. With a medium stroke and right spin, the object ball is pocketed. If the shot was executed properly, the cueball will remain in the center of the table spinning like a top well after the object ball has been pocketed. Thus, two phenomena are revealed: that the object ball does not affect the spin of the cueball on a flush, full-ball hit; and that the rotational energy or spin on the cueball can continue even after the forward rotational energy or roll has stopped. The former phenomenon explains why spin continues to be a factor in cueball behavior and affect position play even after an object ball has been struck. The latter phenomenon explains why balls with running spin actually gain speed off a rail as the rotational energy is convened into forward energy.

Exercise 10

Transfer of English

To understand the effects of what happens to the object ball when struck by a spinning cueball, cueball 12 is placed on the headspot with object ball 14 placed in the center of the table about a foot (30.5 cm) from the cueball with defined central meridian 64 aligned to cross footspot 30. The object ball is struck flush with a right spinning cueball, and the results are observed. The player will appreciate that the object ball wobbles in the direction opposite the spin of the cueball. In effect, the transfer of spin or english from the cue affects the object ball the same as throw. The exercise may be repeated with varying spin and power.

The transfer of spin has practical applications for bank shots in increasing the possible ways to make a shot by opening or shortening angles off the rail. The throw effect allows the player to increase or decrease the cut angle on a shot, while still pocketing the object ball, and thereby provides alternatives in position play. This "cheating" of the ball also affords the player a capability to make "close-but-impossible" shots such as when another object ball is slightly blocking what would be a "natural" center ball aiming. The spin can sometimes throw the ball far enough for it to be pocketed regardless.

Exercise 11

Natural Roll and Stop Shots

To determine how the cueball skids and rolls, cueball 12 is placed on the head spot with the spot of second indicia 48 centered, but this time with the band defined by first indicia 44 oriented horizontally rather than vertically with respect to the playing surface. The ball is stroked straight with medium speed and closely observed. The first and second indicia should be seen to maintain their initial orientation for the first few feet of ball travel, proving that the ball is actually skidding rather than rolling. When the ball thereafter assumes a rolling motion, the band will be observed to roll over the top of the ball. The shot may be repeated using center ball hits with soft, medium, and hard strokes.

Next, object ball 14 may be included for the player to understand how the ability to control how far the cueball skids leads to a very valuable shot, namely, the stop shot. The cueball is aligned as previously, with the object ball spaced two feet (61 cm) therefrom and aligned with a corner pocket. The object ball then is pocketed with a center ball hit of the cueball at a medium stroke speed. The cueball should be observed to stop dead when it hits the object ball, effectively "stunned" into submission. The shot may be repeated with harder and softer strokes with the same effect. It will be seen that the cueball may be stunned on a flush hit regardless of its speed. That is, as long as the ball is skidding without topspin or back spin, it will stop dead with a flush hit of an object ball.

Exercise 12

Stun Shots

As a skidding ball, unlike a top or backspinning ball, will rebound at a precise, predictable geometric angle, the information learned in Exercise 11 proves invaluable for angle shots. That is, when a stun shot is hit, the travel of the cueball after its impact with an object ball is much more predictable.

For practicing stun shots, the balls are aligned as was described in connection with Exercise 12 with the object ball placed at successively greater distances from the cueball. The objective is for the player to pocket the object ball while stunning the cueball, and to learn just how softly the cueball may be stroked to still achieve the desired stun effect. Thus, the shot is begun with medium to hard strokes, and repeated with softer strokes. As the length of the shot is increased, the player will observe that the cueball must be struck either harder or lower. The player who can stun the ball at a distance is well on the way to a better mastery of the game.

Exercise 13

Stun Shots at Angles

Figure 7:
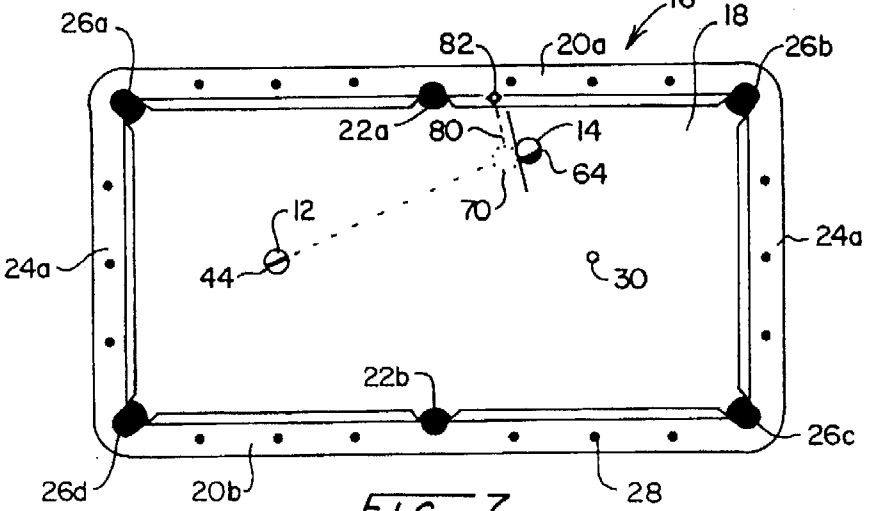
FIG. 7 is a schematic of a top view of the pool table of FIG. 1 showing the practice cueball and object ball of the present invention in an alignment for stun shot exercises.

Cueball 12 is placed again on the headspot, but object ball 14 is set as is shown in FIG. 7 at an angle of about 30° to the cueball with defined central meridian 64 aligned with the center of corner pocket 26*b*. A line, represented at 80, is visualized perpendicular to the path of the object ball from a ghost ball 70 to side rail 20*a*, and is marked with a marker, 82, such as a piece of chalk or the like. Marker 82 marks the spot where the cueball will strike the rail assuming a properly executed stun shot. The player is challenged to both pocket the object ball and have the cueball hit rail 20*a* at marker 82. As always, the shot should be repeated at varying speeds and distances. After this exercise the player will appreciate the true beauty of a stun shot, namely, that the cueball will always travel perpendicular to the path of the object ball.

Exercise 14

Follow

Before proceeding with Exercise 14, Follow, and Exercise 15, Draw, it should be noted that mastery of two elements is required for proper execution of these shots. Firstly, the cueball must be struck at the proper location—upper for follow and lower for draw. Secondly, cue tip speed and a level cue are required.

For practicing follow shots, cueball 12 is placed on the headspot with the spot of second indicia 48 centered and the band of first indicia 44 vertical, and with object ball 14 spaced about 2 feet (61 cm) therefrom. The player begins by hitting medium speed shots just above the spot of second indicia 48. The chalkmark is checked, and the cueball is observed to determine how far, if at all, it follows the travel of the object ball. The striking distance above the center spot is increased and the results are noted for both harder and softer strokes. The distance between the cueball and object ball is increased, and the exercise is repeated. As before, the objective is for the player to learn how softly and how close to the center aiming point the cueball may be struck while still achieving the desired follow effect.

Exercise 15

Draw

The balls are aligned as was described in connection with Exercise 14, and that Exercise is repeated except that the cueball is struck at distances below the central aiming point defined by second indicia 48. The player may be amazed to learn the difficulty in hitting the cueball outside or even close to the edge of the semi-circle defined by third indicia 50. The player also may be amazed at the effect which may be achieved with only a relatively small degree of off-center hit but a relatively good stroke.

Once Exercises 14 and 15 have been performed with some degree of confidence, they may be repeated in connection with a selected aiming point. For example, the player may place a marker two feet (61 cm) past and just off line of the aim. Using soft, medium, and hard strokes, the player may try to follow the cueball to stop next to the marker. The same may be attempted for draw strokes with the marker placed two feet (61 cm) in front of the object ball.

In summary, the practice ball system of the present invention as described in the preceding description and exercises will improve aiming techniques and the detail the effects of achieving spin, stun, follow, and draw. The system, advantageously, functions well in combining these effects, and the player is encouraged to practice them in combination such as high right or low left aiming points on the cueball. With a little practice, the player will notice both an improved confidence and increased knowledge of the game. The practice cueball of the present invention also may be utilized in conjunction with the playing of familiar pool games such as eight-ball, nine-ball, or straight or target pool. The ball may be aligned for each shot without changing its location on the table. After each shot, the results may be noted and the chalkmark examined. The visual feedback which may be gained under real game conditions as approved to be invaluable. Lastly, the system may be used to master the infrequent but especially difficult shots of the pool expert such as shooting at the cueball with an elevated bridge, the massé, and the jump shot. By aligning the band and spot on the cueball, the player may improve his or her aiming techniques and learn exactly which angles will produce varying levels of jump and curve.

It is anticipated that certain changes may be made in the apparatus and method described hereinbefore without departing from the scope of the invention herein involved. For example, the dimensions referred to herein relate to the standard size of American balls and cues. Other pool games, such as snooker, employ smaller balls and smaller cue tips such that measurement of all indicia would change proportionately for practice cue and object balls of the present invention intended for those games. Accordingly, it is intended that all matter contained in the foregoing description of the invention or shown in the accompanying drawings shall be interpreted as illustrative rather than in a limiting sense.

What is claimed:

1. A practice cueball for training in the playing of pool or pocket billiards having a generally spherical outer surface extending about an axis of revolution and having a central meridian, said cue ball being movable along a playing surface as a result having impact by a cue having a tip of a given outer diameter and coatable with chalk, said cueball comprising:

first indicia on said outer surface defining a single band having parallel spaced apart boundaries symmetrically disposed about said central meridian, said band having a width corresponding with said tip outer diameter and being visually perceptible as said ball is moving along a playing surface;

second indicia on said outer surface defining a cue aiming point on said meridian; and third indicia on said outer surface defined by a circular locus of a critical radius extending from said second indicia cue aiming point and defining an impact region therewithin for impact by said tip of said cue.

2. The cueball of claim 1 wherein said third indicia locus terminates at oppositely disposed locations of said band parallel boundaries.

3. The cueball of claim 2 wherein:

said cueball has a diameter of about 2.25 inches; and said critical radius has a value of about 0.5625 inch.

4. The cueball of claim 1 wherein said:

said cueball has a diameter of about 2.25 inches; and said first indicia has a width between said parallel boundaries of about 13 millimeters.

5. The cueball of claim 4 wherein said first indicia is black and said second indicia is red.

6. The cueball of claim 5 in which said third indicia is red and the surface of said cueball is white.

7. The cueball of claim 1 wherein said second indicia is located within said third indicia is located within said third indicia.

8. The cueball of claim 1 which is formed of a material having surface characteristics selected to receive and removably retain a chalkmark from the cue tip.

9. A method for training in the playing of pool or pocket billiards comprising the steps of:

(a) providing a cueball having a generally spherical outer surface coatable with chalk, and extending about an axis of revolutions and having a central meridian, said cue ball being movable on a playing surface as a result of impact by a cue having a tip of a given outer diameter, said cueball including:

first indicia on said outer surface defining a single band having parallel spaced apart boundaries symmetrically disposed about said central meridan, said band having a width corresponding with said tip outer diametr and being visually perceptible as said ball is moving along a playing surface;

second indicia on said outer surface defining a cue aiming point on said meridian; and third indicia on said outer surface defining a circular locus of a critical radius extending from said second indicia central reference point and defining an impact region therewithin for impact by said tip;

(b) aligning said first indicia relative to said playing surface; and (c) impacting said cueball with the tip of a cue to move said cueball along said playing surface; and (d) discerning the rotation of said cueball by visually perceiving the motion of said first indicia.

10. The method of claim 9 wherein said first indicia is aligned in step (b) generally vertical to the playing surface and in registry with an aiming point of the playing surface.

11. The method of claim 9 wherein said first indicia is aligned in step (b) generally horizontal to the playing surface.

12. The method of claim 9 wherein:

said step (c) is performed by stroking said cue at said second indicia; and including the step of (e) subsequently observing the location of a chalk mark on said cueball.

13. The method of claim 9 wherein said cueball is impacted in step (c) within said impact region at a select distance from said aiming point to rotate said cueball about an axis of spin disposed at some angle with respect to the playing surface.

14. A method for training in the playing of pool or pocket billiards comprising the steps of:

(a) providing a cueball having a generally spherical outer surface extending about an axis of revolution and having a central meridian, said cueball being movable along a playing surface from impact by a cue, said cue having a tip of a given outer diameter, said cueball including first indicia on said outer surface defining said central meridian;

(b) providing an object ball having a generally spherical outer surface extending about an axis of revolution and having a central meridian, said object ball being movable along the playing surface from impact by said cueball, said object ball comprising a first hemisphere having an outer surface of a first color, and a second hemisphere having an outer surface of a second color different from said first color, said first and second hemisphere meeting along a circular locus to define said central meridian of said object ball;

(c) aligning the defined central meridian of said object ball with an aiming point;

(d) aligning said first indicia of said cueball relative to the defined central meridian of said object ball;

(e) impacting said cueball with the tip of a cue to move said cueball along the playing surface into impact with said object ball;

(f) discerning the rotation of said cueball by visually perceiving the motion of said first indicia; and (g) discerning the rotation of said object ball by visually perceiving the motion of the defined central meridian of said object ball.

15. The method of claim 14 wherein said first color is black and said second color is red.

16. The method of claim 14 wherein the defined central meridian of said object ball is aligned in step (c) generally vertical to the playing surface.

17. The method of claim 16 wherein said playing surface includes at least one pocket and the defined central meridian is aligned in step (c) with the pocket.

18. The method of claim 16 wherein said first indicia of said cueball is aligned in step (d) generally vertical to the playing surface.

19. The method of claim 18 wherein said first indicia of said cueball is aligned in step (d) in registry with the defined central meridian of said object ball.

20. The method of claim 14 wherein said cueball is provided in step (a) with second indicia on said outer surface defining a central reference point on said meridian, and wherein said cueball is impacted in step (e) at said central reference point.

21. The method of claim 14 wherein said cueball is provided in step (a) with third indicia on said outer surface at least partially circumscribing said aiming point to define an impact region, said cueball being impacted in step (e) within said impact region effective to rotate said cueball about an axis of spin disposed at some angle with respect to the playing surface.

* * * * *